US005468034A

United States Patent [19]

Kopel

[11] Patent Number: 5,468,034

[45] Date of Patent: Nov. 21, 1995

[54] APPARATUS FOR PULLING ARROWS FROM SURFACES IN WHICH THEY ARE EMBEDDED

[76] Inventor: Larry L. Kopel, 206 N. 5th St., Marshalltown, Iowa 50158

[21] Appl. No.: 306,603

[22] Filed: Sep. 15, 1994

[51] Int. Cl.[6] ..... B23P 19/04; B65G 7/12

[52] U.S. Cl. ..... 294/1.1; 29/278; 294/15

[58] Field of Search ..... 294/1.1, 15, 26; 29/267, 270, 278, 280, 281, 283; 124/23.1; 254/131, 133 R

[56] References Cited

U.S. PATENT DOCUMENTS

| | | | |
|---|---|---|---|
| 3,385,625 | 5/1968 | Heines | 294/26 |
| 3,458,895 | 8/1969 | Miller | 29/278 |
| 3,873,068 | 3/1975 | Allen | 294/26 X |
| 3,890,692 | 6/1975 | Jandura | 29/270 X |
| 4,169,454 | 10/1979 | Jones | 124/23.1 |
| 5,102,100 | 4/1992 | Troncoso | 29/267 X |
| 5,301,924 | 4/1994 | Kammerer | 29/267 X |

*Primary Examiner*—Johnny D. Cherry

[57] ABSTRACT

An apparatus for pulling arrows from surfaces in which they are embedded comprising: an elongated cylindrical shank having a front end and a rear end; an aperture formed in the front end, the aperture being of a cylindrical non-threaded configuration adjacent to the front end and of a reduced diameter with internal threads extending rearwardly from the front end of the unthreaded aperture, the threaded aperture adapted to receive the external threads at the trailing edge of a broad-head arrow; a threaded aperture extending forwardly from the rear end to the shank; a T-handle having a rectangular cross-section with a central aperture extending therethrough; and a bolt extending into the threaded rear end of the shank whereby the leading end may be threadably attached to the trailing end of a broad-head arrow and a linear force applied by a user grasping and pulling the T-handle along the axis of the shank.

3 Claims, 4 Drawing Sheets

APPARATUS FOR PULLING ARROWS FROM SURFACES IN WHICH THEY ARE EMBEDDED

BACKGROUND OF THE INVENTION

1. Field of the Invention

The present invention relates to an apparatus for pulling arrows from surfaces in which they are embedded and more particularly pertains to applying a linear force to a broad-head arrow embedded in a tree or other object to effect its removal without bending the arrow or snapping off the head.

2. Description of the Prior Art

The use of arrow head pullers of a wide variety of designs and configurations is known in the prior art. More specifically, arrow head pullers of a wide variety of designs and configurations heretofore devised and utilized for the purpose of applying a withdrawal force to an embedded arrow through a wide variety of methods and apparatuses are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 3,441,251 a tool for removing arrows and arrowheads from trees.

U.S. Pat. No. 3,826,471 discloses a device for pulling arrowheads from implantation in solid objects.

U.S. Pat. No. 4,169,454 discloses a combination of an archery bow, bow stabilizer and arrow head extractor.

U.S. Pat. No. 5,102,100 discloses an archery arrowhead puller device.

U.S. Pat. No. 5,205,541 discloses an arrow head extractor.

In this respect, the apparatus for pulling arrows from surfaces in which they are embedded according to the present invention substantially departs from the conventional concepts and designs of the prior art, and in doing so provides an apparatus primarily developed for the purpose of to apply a linear force to a broad-head arrow embedded in a tree or other object to effect its removal without bending the arrow or snapping off the head.

Therefore, it can be appreciated that there exists a continuing need for new and improved apparatus for pulling arrows from surfaces in which they are embedded which can be used for applying a linear force to a broad-head arrow to effect its removal without bending the arrow or snapping off the head. In this regard, the present invention substantially fulfills this need.

SUMMARY OF THE INVENTION

In view of the foregoing disadvantages inherent in the known types of arrow head pullers of a wide variety of designs and configurations now present in the prior art, the present invention provides an improved apparatus for pulling arrows from surfaces in which they are embedded. As such, the general purpose of the present invention, which will be described subsequently in greater detail, is to provide a new and improved apparatus and method for pulling arrows from surfaces in which they are embedded which has all the advantages of the prior art and none of the disadvantages.

To attain this, the present invention essentially comprises a new and improved apparatus for pulling arrows from surfaces in which they are embedded comprising, in combination: a cylindrical shank having a front end and a rear end with a length of about three and a half inches and a diameter of about three-eighth inch; an aperture formed in the front end, the aperture being of a cylindrical non-threaded configuration adjacent to the front end and of a reduced diameter with internal threads extending rearwardly from the front end of the unthreaded aperture, the threaded aperture adapted to receive the external threads at the trailing edge of a broad-head arrow; a threaded aperture extending forwardly from the rear end to the shank; a T-handle having a rectangular cross-section with a length of about two and one-fourth inches and a central aperture extending therethrough with internal threads formed in the aperture and a countersunk hole thereadjacent, the cross-section of the T-handle being square about three-eighths inches on each side; and a flat head bolt with a counter-sunk head positioned within the countersunk hole and extending into the threaded rear end of the shank whereby the leading end may be threadably attached to the trailing end of a broad-head arrow and a linear force applied by a user grasping and pulling the T-handle along the axis of the shank.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved apparatus for pulling arrows from surfaces in which they are embedded which has all the advantages of the prior art arrow head pullers of a wide variety of designs and configurations and none of the disadvantages.

It is another object of the present invention to provide a new and improved apparatus for pulling arrows from surfaces in which they are embedded which may be easily and efficiently manufactured and marketed.

It is further object of the present invention to provide a new and improved apparatus for pulling arrows from surfaces in which they are embedded which is of a durable and reliable construction.

An even further object of the present invention is to provide a new and improved apparatus for pulling arrows from surfaces in which they are embedded which is susceptible of a low cost of manufacture with regard to both materials and labor, and which accordingly is then susceptible of low prices of sale to the consuming public, thereby making such apparatus for pulling arrows from surfaces in which they are embedded economically available to the buying public.

Still yet another object of the present invention is to provide a new and improved apparatus for pulling arrows from surfaces in which they are embedded which provide in the apparatuses and methods of the prior art some of the advantages thereof, while simultaneously overcoming some of the disadvantages normally associated therewith.

Still another object of the present invention is to apply a linear force to a broad-head arrow embedded in a tree or other object to effect its removal without bending the arrow or snapping off the head.

Lastly, it is an object of the present invention to provide new and improved apparatus for pulling arrows from surfaces in which they are embedded comprising: an elongated cylindrical shank having a front end and a rear end; an aperture formed in the front end, the aperture being of a cylindrical non-threaded configuration adjacent to the front end and of a reduced diameter with internal threads extending rearwardly from the front end of the unthreaded aperture, the threaded aperture adapted to receive the external threads at the trailing edge of a broad-head arrow; a threaded aperture extending forwardly from the rear end to the shank; a T-handle having a rectangular cross-section with a central aperture extending therethrough; and a bolt extending into the threaded rear end of the shank whereby the leading end may be threadably attached to the trailing end of a broad-head arrow and a linear force applied by a user grasping and pulling the T-handle along the axis of the shank.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
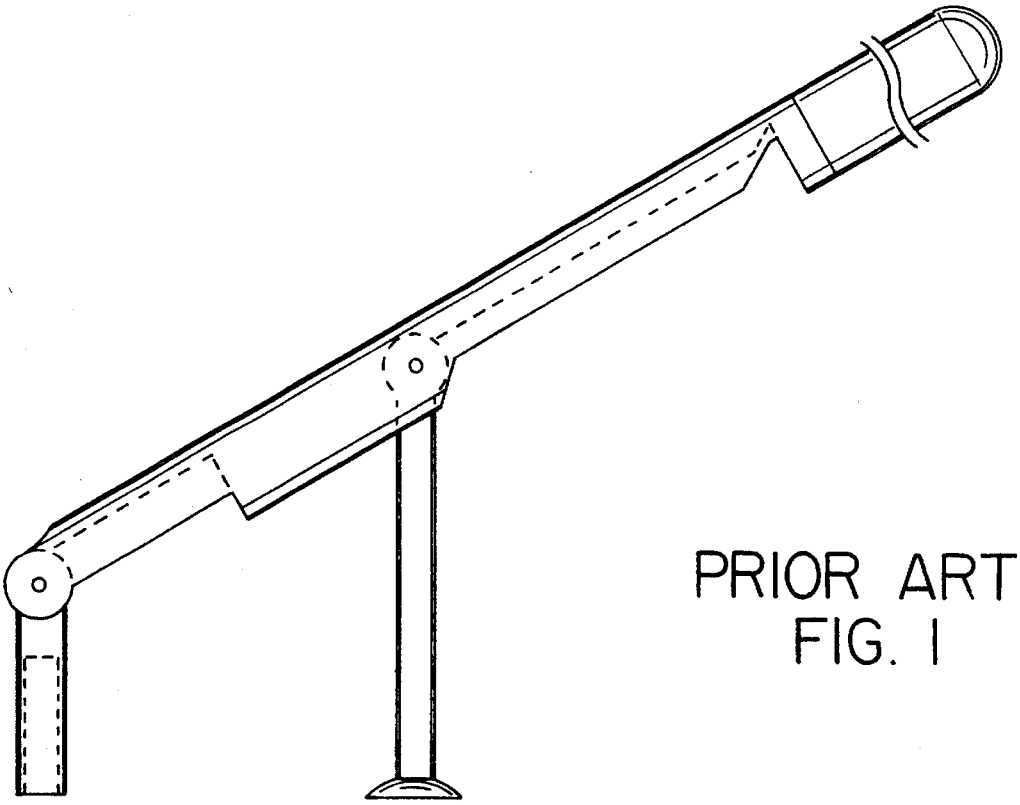
PRIOR ART FIG. 1
FIG. 1 is a side elevational view of a device in the prior art for pulling embedded arrow heads.
Figure 2:
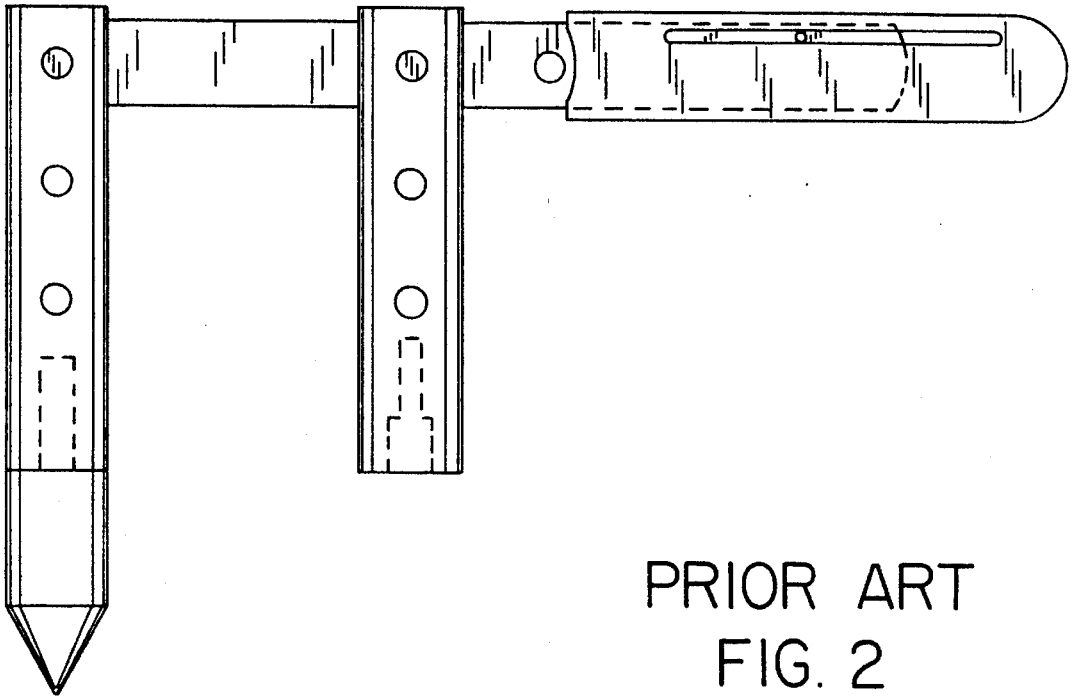
PRIOR ART FIG. 2
FIG. 2 is another type of prior art device designed for pulling arrow heads.
Figure 3:
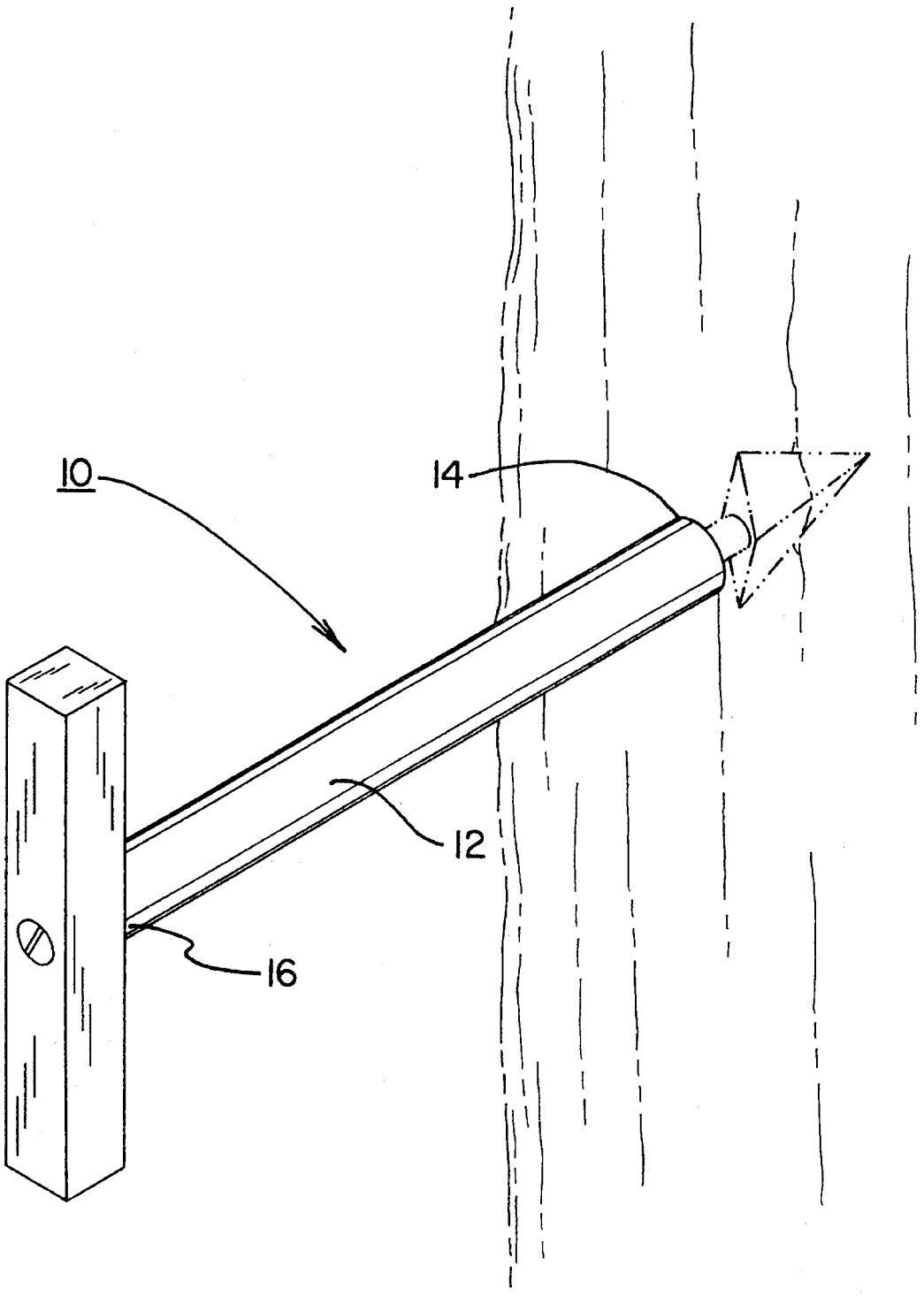
FIG. 3 is a perspective view of the preferred embodiment of the new and improved apparatus for pulling arrows from surfaces in which they are embedded constructed in accordance with the principles of the present invention.
Figure 4:
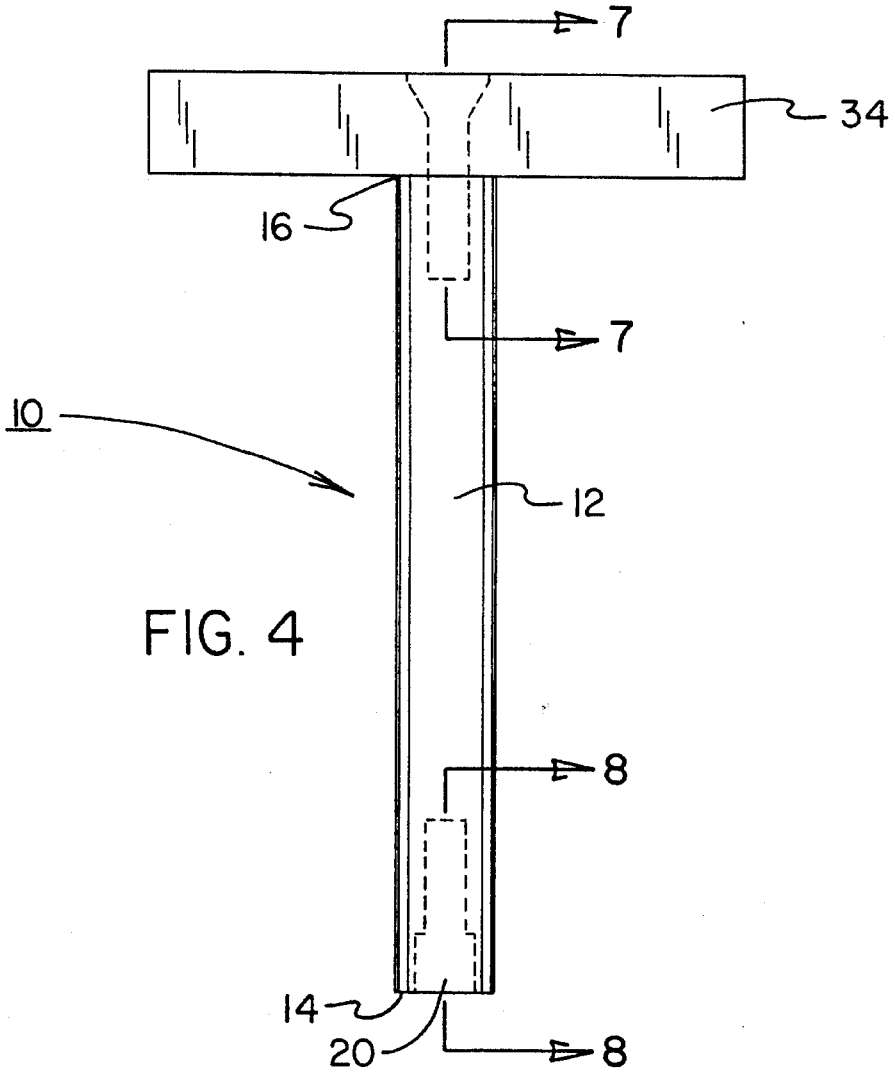
FIG. 4 is a side elevational view of the device shown in FIG. 3.
Figure 5:
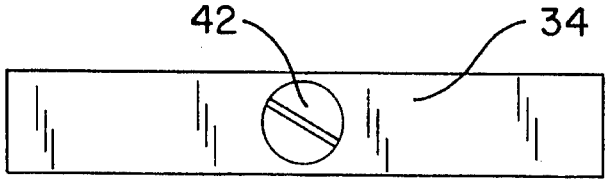
FIG. 5 is a top elevational view of the device shown in FIGS. 3 and 4.
Figure 6:
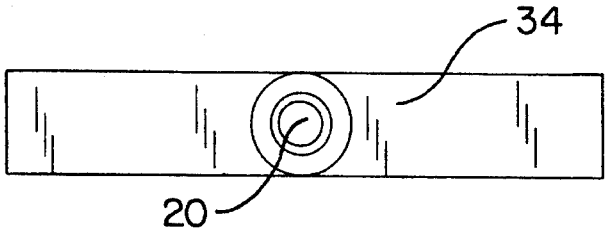
FIG. 6 is a bottom elevational view of the device shown in FIGS. 3 and 4.
Figure 7:
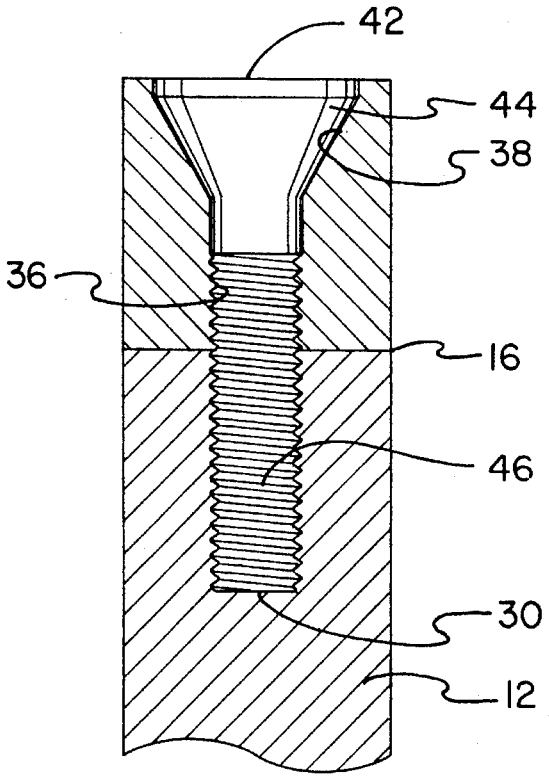
FIG. 7 is a cross-sectional view taken along line 7—7 of FIG. 4.
Figure 8:
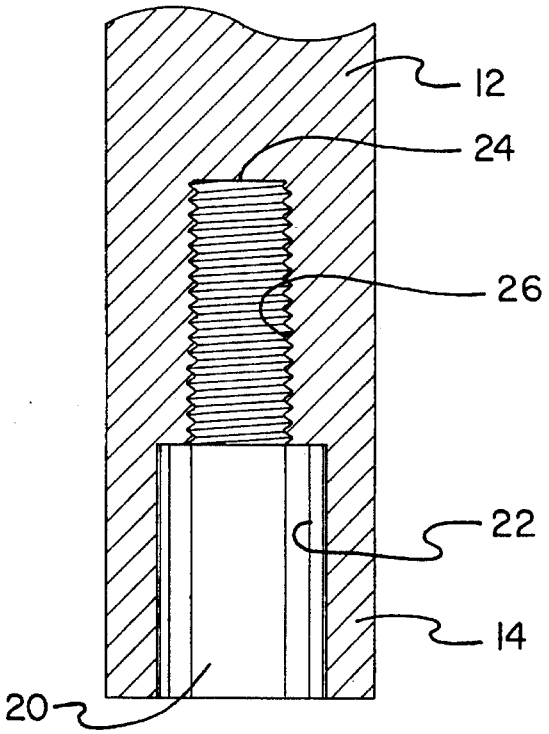
FIG. 8 is a cross-sectional view taken along line 8—8 of FIG. 4.

With reference now to the drawings, and in particular to FIG. 3 thereof, the preferred embodiment of the new and improved apparatus for pulling arrows from surfaces in which they are embedded embodying the principles and concepts of the present invention and generally designated by the reference numeral 10 will be described.

The present invention, the new and improved apparatus for pulling arrows from surfaces in which they are embedded, is comprised of a plurality of components. Such components include a shank, an aperture in the front end of the shank, an aperture in the rear end of the shank, a T-handle and a flat-head bolt. Such components are individually configured and correlated with respect to each other so as to attain the desired objective.

The central component of the system 10 of the present invention is a cylindrical shank 12. Such shank has a front end 14 and a rear end 16. Its length is about 3½". It has a diameter of about ⅜ of an inch.

An aperture 20 is formed in the front end of the shank. The aperture is of a cylindrical configuration. It has a non-threaded portion 22 adjacent to the front end. The aperture also has a forward section 24 of a reduced diameter. Such forward section has internal threads 26 extending rearwardly from the front end of the unthreaded aperture. The threaded aperture is adapted to receive the external threads of an arrowhead at the trailing edge of such arrowhead.

Next provided on the shank at the rear end, opposite from the front end is a threaded aperture 30 Such threaded aperture extends forwardly from the rear end of the shank. The axes of all of the apertures are coextensive with the axis of the shank.

Next provided is a T-handle 34. Such T-handle has a rectangular cross-section. Note FIG. 3. It is preferably square. It has a length of about 2¼". It is formed with a central aperture 36 extending therethrough. Internal threads are formed in the aperture adjacent one end. A countersunk hole 38 is formed thereadjacent as a continuation with the widest portion of the countersunk hole adjacent to the exposed free rearmost surface of the handle. The opposite surface of the handle is adjacent to the rear end of the shank. The cross-section of the T-handle is preferably square about 3" on each side.

The last component of the system is a flat-head bolt 42. It has a countersunk head 44 which is adapted to be positioned within the countersunk hole of the T-handle. The bolt extends internally through the internal threads of the T-handle. Thereafter, it extends into the threaded rear end of the shank. In this manner, the leading end of the shank with threads 26 may be threadably attached to the trailing end of a broadhead arrow with the T-handle coupled to the shank at the rear end through the bolt. Thereafter the user may apply a linear force by the grasping and pulling of the T-handle along the axis of the shank.

In the preferred embodiment of the invention, the shank is fabricated of steel. Similarly, the T-handle as well as the bolt may likewise be fabricated of steel.

The present invention is a simple tool which will remove arrows that have become deeply embedded, without damaging them. A broadhead arrow stuck in a tree is almost impossible to withdraw by hand, without bending it or snapping off the head.

Broadhead arrows have head which have threaded studs that are screwed into threaded holes in the ends of the shafts. When the arrows are pulled by one or two hands in an attempt to dislodge them without damage, it is almost impossible to do so because a perfectly straight pull cannot be applied along the axis of the arrow.

This invention offers a small T-handle wrench that removes the arrow head cleanly and without damage. Rather than pulling on the shaft, it is unscrewed from the head. The end of the wrench has a hole which has threads that match those on the arrowhead stud. After the wrench is screwed on the stud, the T-handle permits a perfectly straight pull to be applied on the stud, the T-handle permits a perfectly straight pull to be applied to withdraw the head. Because the pulling forces on the T-handle are balanced on each side, no side forces are applied on the stud, which would cause it to snap off.

Typically, the present invention is made of steel, with a ⅜" diameter round shank that is about 3½" long. The T-handle is about 2¼" long and is centered across the shank, attached by any suitable method. In production, it could also be made in a single piece.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An apparatus for pulling arrows from surfaces in which they are embedded comprising, in combination:

a cylindrical shank having a front end and a rear end with a length of about three and a half inches and a diameter of about three-eighths inch;

an aperture formed in the front end, the aperture extending axially within the front end and formed in a cylindrical configuration, the aperture including a non-threaded outboard section and an inboard section having a reduced diameter with internal threads, the threaded inboard section of the aperture adapted to receive the external threads at the trailing end of a broad-head arrow;

a threaded aperture extending forwardly from the rear end of the shank;

a T-handle having a rectangular cross-section with a length of about two and one-fourth inches and a central aperture extending therethrough with internal threads formed in the aperture and a countersunk hole there-adjacent, the cross-section of the T-handle being square about three-eights inches on each side; and a flat head bolt with a leading end and a counter-sunk head positioned within the countersunk hole and extending into the threaded rear end of the shank whereby the leading end may be threadably attached to the trailing end of a broad-head arrow and a linear force applied by a user grasping and pulling the T-handle along the axis of the shank.

2. An apparatus for pulling arrows from surfaces in which they are embedded comprising:

an elongated cylindrical shank having a front end and a rear end;

an aperture formed in the front end, the aperture extending axially within the front end and formed in a cylindrical configuration, the aperture including a non-threaded outboard section and a threaded inboard section having a reduced diameter, the threaded inboard section of the aperture adapted to receive the external threads at the trailing end of a broad-head arrow;

a threaded aperture extending forwardly from the rear end of the shank;

a T-handle having a rectangular cross-section with a central aperture extending therethrough; and a bolt with a threaded leading end extending into the threaded rear end of the shank whereby the leading end may be threadably attached to the trailing end of a broad-head arrow and a linear force applied by a user grasping and pulling the T-handle along the axis of the shank.

3. The apparatus as set forth in claim 2 wherein the shank is fabricated of steel.

* * * * *